US009371165B2

(12) United States Patent
Brannon et al.

(10) Patent No.: US 9,371,165 B2
(45) Date of Patent: Jun. 21, 2016

(54) TWO-PIECE CHILD-RESISTANT DISPENSING CLOSURE

(71) Applicant: MWV Slatersville, LLC, Slatersville, RI (US)

(72) Inventors: Patrick J. Brannon, Warwick, RI (US); Clifford W. Skillin, Blackstone, MA (US)

(73) Assignee: WESTROCK SLATERSVILLE, LLC, Norcross, GA (US)

( * ) Notice: Subject to any disclaimer, the term of this patent is extended or adjusted under 35 U.S.C. 154(b) by 0 days.

(21) Appl. No.: 14/458,915

(22) Filed: Aug. 13, 2014

(65) Prior Publication Data

US 2015/0048113 A1 Feb. 19, 2015

Related U.S. Application Data

(60) Provisional application No. 61/866,752, filed on Aug. 16, 2013.

(51) Int. Cl.

| | |
|---|---|
| ***B65D 47/12*** | (2006.01) |
| ***B65D 50/04*** | (2006.01) |
| ***B65D 47/40*** | (2006.01) |
| *B65D 23/06* | (2006.01) |
| *B65D 51/16* | (2006.01) |

(52) U.S. Cl.

CPC ..... *B65D 50/046* (2013.01); *B65D 47/40* (2013.01); *B65D 23/06* (2013.01); *B65D 47/123* (2013.01); *B65D 51/1616* (2013.01)

(58) Field of Classification Search

CPC ..... B65D 23/06; B65D 23/065; B65D 47/40

USPC ..... 222/109, 111

See application file for complete search history.

(56) References Cited

U.S. PATENT DOCUMENTS

| | | | |
|---|---|---|---|
| 817,465 | A | 4/1906 | Bragg |
| 2,817,465 | A | 12/1957 | Gray |
| 2,920,799 | A | 1/1960 | Binder |
| 3,059,822 | A | 10/1962 | Eisendath et al. |
| 3,208,650 | A | 9/1965 | Ham |
| 4,310,105 | A | 1/1982 | Gach |
| 4,416,381 | A | 11/1983 | Swartwout |
| 4,550,862 | A | 11/1985 | Barker et al. |

(Continued)

FOREIGN PATENT DOCUMENTS

| | | | |
|---|---|---|---|
| DE | 8431343 | U1 | 4/1985 |
| EP | 0109704 | A1 | 5/1994 |

(Continued)

*Primary Examiner* — Daniel R Shearer

(74) *Attorney, Agent, or Firm* — Barlow, Josephs & Holmes, Ltd.

(57) ABSTRACT

A child resistant dispensing closure for dispensing a product from a container has a cap base and a cap that can be secured to a container. The cap base has a locking tab that engages a locking lug on a container, to prevent removal of the cap base from the container. To seal a pour spout on the cap base, a cap is removably secured to the cap base. A child resistant mechanism prevents accidental removal of the cap from the cap base. The child resistant mechanism may include a child resistant stop tab on the cap that selectively engages a child resistant stop lug located on either the container or the cap base. Alternatively, the child resistant mechanism may include a latch hook on the cap base that selectively engages a stepped locking shoulder on the cap skirt.

4 Claims, 21 Drawing Sheets

(56) References Cited

U.S. PATENT DOCUMENTS

| | | | | |
|---|---|---|---|---|
| 4,566,508 | A | 1/1986 | Bowyer | |
| 4,629,081 | A | 12/1986 | McLaren | |
| 4,706,829 | A * | 11/1987 | Li | 215/354 |
| 4,834,251 | A | 5/1989 | Yu | |
| 4,836,419 | A * | 6/1989 | Metz et al. | 222/110 |
| 4,917,268 | A | 4/1990 | Campbell et al. | |
| 4,948,002 | A | 8/1990 | Thornock et al. | |
| 4,974,749 | A | 12/1990 | Mon | |
| 4,984,714 | A | 1/1991 | Sledge | |
| 5,060,827 | A | 10/1991 | Segati | |
| 5,078,288 | A | 1/1992 | Fuchs | |
| 5,101,993 | A * | 4/1992 | Nairn et al. | 215/232 |
| 5,108,009 | A | 4/1992 | Davidson et al. | |
| 5,251,788 | A | 10/1993 | Moore | |
| 5,358,872 | A | 10/1994 | Mussi et al. | |
| 5,433,338 | A | 7/1995 | Proshan | |
| 5,435,467 | A | 7/1995 | Ekkert et al. | |
| 5,462,202 | A | 10/1995 | Haffner et al. | |
| 5,529,202 | A | 6/1996 | Shamis | |
| 5,727,703 | A | 3/1998 | Fuchs | |
| 5,765,705 | A | 6/1998 | Deubel | |
| 5,794,803 | A | 8/1998 | Sprick | |
| 5,850,953 | A | 12/1998 | Dallas, Jr. | |
| 5,875,942 | A | 3/1999 | Ohmi et al. | |
| 5,941,422 | A | 8/1999 | Struble | |
| 6,032,829 | A | 3/2000 | Geisinger et al. | |
| 6,036,036 | A | 3/2000 | Bilani et al. | |
| 6,109,487 | A | 8/2000 | Hashimoto | |
| 6,168,035 | B1 | 1/2001 | McLelland | |
| 6,223,946 | B1 | 5/2001 | Geisinger et al. | |
| 6,367,670 | B1 | 4/2002 | Warner et al. | |
| 6,398,076 | B1 | 6/2002 | Giblin et al. | |
| 6,464,106 | B1 | 10/2002 | Giblin et al. | |
| 6,622,615 | B2 | 9/2003 | Heczko | |
| 6,648,913 | B1 | 11/2003 | Yee et al. | |
| 6,848,484 | B1 | 2/2005 | Darr | |
| 6,866,164 | B2 | 3/2005 | Branson et al. | |
| 6,923,341 | B2 | 8/2005 | Smith | |
| 6,964,359 | B1 | 11/2005 | Darr et al. | |
| D515,419 | S | 2/2006 | Manke | |
| 7,100,785 | B1 * | 9/2006 | Suffa | B65D 41/0471 215/211 |
| 7,128,227 | B2 | 10/2006 | Skillin et al. | |
| 7,207,466 | B2 | 4/2007 | Walsh et al. | |
| 7,296,700 | B2 | 11/2007 | Steele, IV et al. | |
| 7,520,410 | B2 | 4/2009 | Gilbertson et al. | |
| 7,673,774 | B2 | 3/2010 | Molloy et al. | |
| 7,686,188 | B2 | 3/2010 | Stebick et al. | |
| 7,721,916 | B2 * | 5/2010 | Szekely | B65D 47/123 222/109 |
| 7,841,489 | B2 | 11/2010 | Gilbertson et al. | |
| 7,870,980 | B2 | 1/2011 | Wilson et al. | |
| 7,959,034 | B2 | 6/2011 | Faaborg et al. | |
| 7,980,403 | B2 | 7/2011 | Martinez | |
| 8,011,535 | B2 | 9/2011 | Tauber et al. | |
| 8,025,183 | B2 | 9/2011 | Szekely et al. | |
| 8,292,101 | B1 * | 10/2012 | Bragg | B65D 50/046 215/237 |
| 8,474,657 | B2 * | 7/2013 | Szekely | B65D 47/125 215/329 |
| 8,523,024 | B2 | 9/2013 | Piscopo et al. | |
| 8,651,304 | B2 | 2/2014 | Skillin et al. | |
| 2004/0182814 | A1 | 9/2004 | Suffa | |
| 2005/0039821 | A1 | 2/2005 | Darr | |
| 2005/0103803 | A1 | 5/2005 | Hung et al. | |
| 2005/0145655 | A1 | 7/2005 | Giblin et al. | |
| 2007/0194047 | A1 | 8/2007 | Tauber et al. | |
| 2008/0011708 | A1 | 1/2008 | Rappin | |
| 2009/0045224 | A1 | 2/2009 | Faaborg et al. | |
| 2010/0116776 | A1 | 5/2010 | Szekely | |
| 2010/0243598 | A1 | 9/2010 | Straughan | |
| 2010/0320168 | A1 | 12/2010 | Bull | |
| 2011/0204099 | A1 | 8/2011 | Piscopo et al. | |
| 2011/0284541 | A1 | 11/2011 | Webster et al. | |
| 2011/0297698 | A1 * | 12/2011 | Chiang et al. | 222/109 |
| 2012/0012613 | A1 | 1/2012 | Tauber et al. | |
| 2013/0161281 | A1 * | 6/2013 | Skillin et al. | 215/219 |

FOREIGN PATENT DOCUMENTS

| | | | |
|---|---|---|---|
| JP | 56024461 | U | 3/1981 |
| JP | 2000025821 | A | 1/2000 |
| JP | 2004210354 | A | 7/2004 |
| WO | 2012170731 | A1 | 12/2012 |

* cited by examiner

TWO-PIECE CHILD-RESISTANT DISPENSING CLOSURE

CROSS-REFERENCE TO RELATED APPLICATIONS

The present application is a non-provisional application which claims the benefit of provisional U.S. Application No. 61,866,752, filed Aug. 16, 2013, the entire contents of which are incorporated herein by reference.

BACKGROUND OF THE INVENTION (1) Field of the Invention

The instant invention relates to dispensing closures for flowable products, such as household chemicals, and more particularly to a dispensing closure that has a cap base and a cap that form a two-piece child-resistant dispensing closure for a container.

(2) Description of Related Art

Manufacturers of household chemical products, such as cleaners, detergents, chlorine, etc. routinely employ dispensing closures to quickly and easily dispense product directly from the container. These dispensing closures are typically installed on a dispensing neck of the product container. However, because there are dangers associated with access to the product by children, there is a critical need to provide mechanisms to prevent a child from opening such dispensing closures.

SUMMARY OF THE INVENTION

The instant invention provides several embodiments of a child-resistant dispensing closure for dispensing a product from a container. Generally, the dispensing closure has a cap base and a cap that can be secured to an open end of a container. Threads on the cap base engage threads on the container. Once the cap base is secured to the container, it is locked in place by a ratcheting mechanism. The container is then sealed by a cap secured to the cap base. Threads on the cap engage threads on the cap base, and once the cap is secured to the cap base, it is held in place by a child resistant mechanism. To dispense a product from the container, a user disengages the child resistant mechanism and removes the cap from the cap base and container, and then pours a product from a pour spout on the cap base.

In one embodiment, the cap base has a deck and an outer base skirt depending from the deck. The outer base skirt has an inwardly threaded inner surface for engaging an outwardly threaded dispensing neck on a container. To direct a product being dispensed from the container, a pour spout extends upwardly from the deck. A dispensing passage is defined within the pour spout. The pour spout has a front and a rear, and there may be a pour lip formed at a front terminal edge of the pour spout. The pour lip allows a product to be cleanly dispensed from the pour spout.

To allow a product to drain back into the container, an annular drain-back channel may encircle the pour spout and depend downwardly from the deck within the lower skirt. The drain-back channel has a bottom wall sloping downwardly towards a rear terminal edge of the pour spout, and a drain-back opening is formed in the drain-back channel.

To secure the cap base to the container in a predetermined orientation, at least one locking tab may extend from the outer base skirt. It engages a locking lug on the container to align the cap base on the container and prevent removal of the cap base from the container when the cap base is threadably engaged on the container neck.

To cover the pour spout, the dispensing closure has a cap. The cap has an upper wall and an outer cap skirt depending downwardly from the upper wall and having an inwardly threaded inner surface for engaging an outwardly threaded lower skirt on the cap base. An annular sealing wall depends downwardly from the upper wall on the cap and is configured to sealingly engage an outer wall of the drain back channel in the cap base.

Finally, a child resistant stop tab may extend inwardly from the inner surface of the outer cap skirt. The child resistant stop tab engages a child resistant stop lug on the container when the cap is threadably engaged with the cap base to prevent inadvertent removal of the cap from the cap base. When a user is ready to remove the cap from the cap base, the user applies radial inward pressure to the outer cap skirt at opposing positions spaced from the child stop tab to deform the outer cap skirt outwardly so that the child resistant stop tab clears the child resistant stop lug.

In another exemplary embodiment, the structure is similar to the first embodiment except for the location of the child resistant stop lug and the child resistant stop tab. In this embodiment, the child resistant stop lug extends outwardly from the outer base skirt, and the child resistant stop tab extends inwardly from the inner surface of the outer cap skirt. The child resistant stop tab can engage the child resistant stop lug on the cap base when the cap is threadably engaged with the cap base to prevent inadvertent removal of the cap from the cap base unless a radial inward pressure is applied to the outer cap skirt at opposing positions spaced from the child resistant stop tab to deform the outer cap skirt outwardly so that the child resistant stop tab clears the child resistant stop lug.

In further embodiments, the cap base has a deck, an inner lower skirt, an upper skirt, and an outer peripheral skirt. The inner lower skirt depends downwardly from the deck, and has an inwardly threaded inner surface for engaging an outwardly threaded dispensing neck on a container. The upper skirt extends upwardly from the deck, and has an outwardly threaded outer surface. The outer peripheral skirt has a lower portion depending downwardly from the deck and an upper portion extending upwardly from the deck. At least one locking tab extends inwardly from the lower portion. The locking tab engages a locking lug on the container to align the cap base on the container and to prevent removal of the cap base from the container when the cap base is threadably engaged on the container neck.

To direct a product being dispensed from the container, a pour spout extends upwardly from the deck. A dispensing passage is defined within the pour spout. The pour spout has a front and a rear, and a pour lip formed at a front terminal edge of the pour spout.

An annular drain-back channel encircles the pour spout and depends downwardly from the deck within the lower skirt. The drain-back channel has a bottom wall sloping downwardly towards a rear terminal edge of the pour spout.

A drain-back opening is formed in the drain-back channel so that a product may drain from the channel back into the container.

The cap has an upper wall, an outer cap skirt, an inner annular sealing wall, and a stepped locking shoulder. The outer cap skirt depends downwardly from the upper wall, and has an inwardly threaded inner surface for engaging the outwardly threaded outer surface on the upper skirt of the cap base. The inner annular sealing wall depends downwardly from the upper wall, and is configured to sealingly engage an outer wall of the drain back channel in the cap base. The stepped locking shoulder is formed on an outer surface of the cap skirt.

At least one inwardly extending latch hook is formed on an upper edge of the outer peripheral skirt of the cap base for engaging the stepped locking shoulder on the cap skirt when the cap is threadably received on the cap base to prevent inadvertent removal of the cap from the cap base.

At least one latch hook actuator tab is integrally formed as a part of the outer peripheral skirt of the cap base and is adjacent to the latch hook. A radial inward pressure on the latch hook actuator tab causes a corresponding radial outward movement of the latch hook to disengage the latch hook from the stepped shoulder and to allow removal of the cap.

For some products such as laundry detergents, household cleaners, household pesticides and fertilizers, household chemicals, and bleach, it may be desirable to incorporate a vent into the cap. Thus, in some embodiments of the dispensing enclosure, there is an off-gassing aperture in the upper wall of the cap. An annular wall surrounds the off-gassing aperture, and an off-gassing insert can be frictionally received within the annular wall. Gases may pass through the off-gassing aperture, but liquids and solid particles are repelled by the off-gassing insert. The off-gassing insert may be expanded polytetraflouroethylene (ePTFE) or another material.

Accordingly, the embodiments of the invention can include a clean pour spout cutoff, a drain back well, anti-glug dispensing, vented pouring, and a vented cap lid insert. The dispensing closure may also have a cap base to bottle ratcheting lock and an orientation system. In some embodiments, the dispensing closure may have a child resistant mechanism that is disengaged by either squeezing a cap or pressing an actuator tab.

BRIEF DESCRIPTION OF THE DRAWINGS

While the specification concludes with claims particularly pointing out and distinctly claiming particular embodiments of the instant invention, various embodiments of the invention can be more readily understood and appreciated from the following descriptions of various embodiments of the invention when read in conjunction with the accompanying drawings in which:

DETAILED DESCRIPTION OF THE INVENTION

Figure 1:
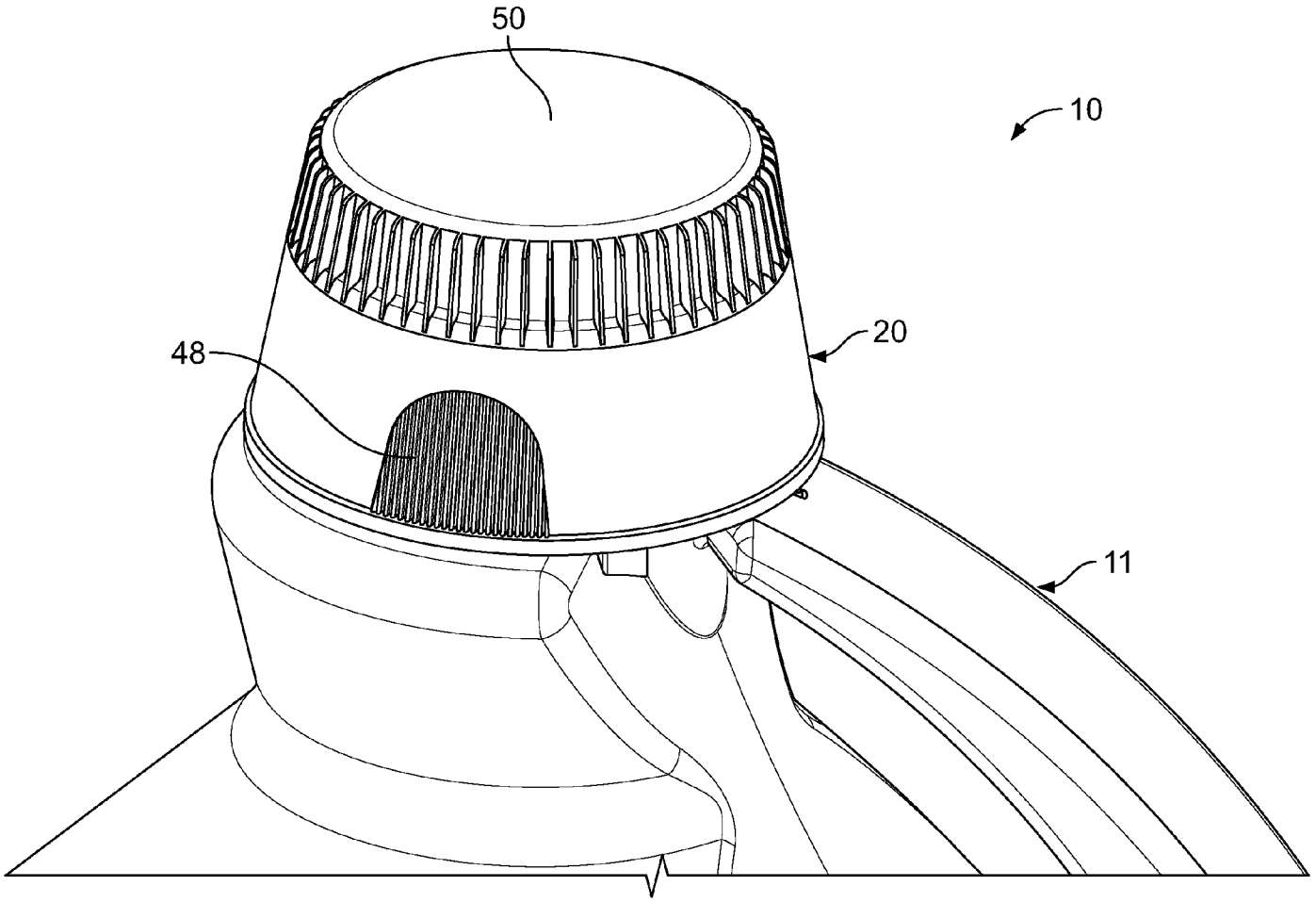
FIG. 1 is a perspective view of an exemplary embodiment of a dispensing closure of the present invention.

Referring now to the drawings, exemplary embodiments of the two-piece child-resistant dispensing closure of the instant invention are illustrated and generally indicated FIGS. 1-21. As will hereinafter be more fully described, the instant invention relates to dispensing closures for containers for flowable products, such as household chemicals, and more particularly to a dispensing closure having a child resistant mechanism.

Figure 2:
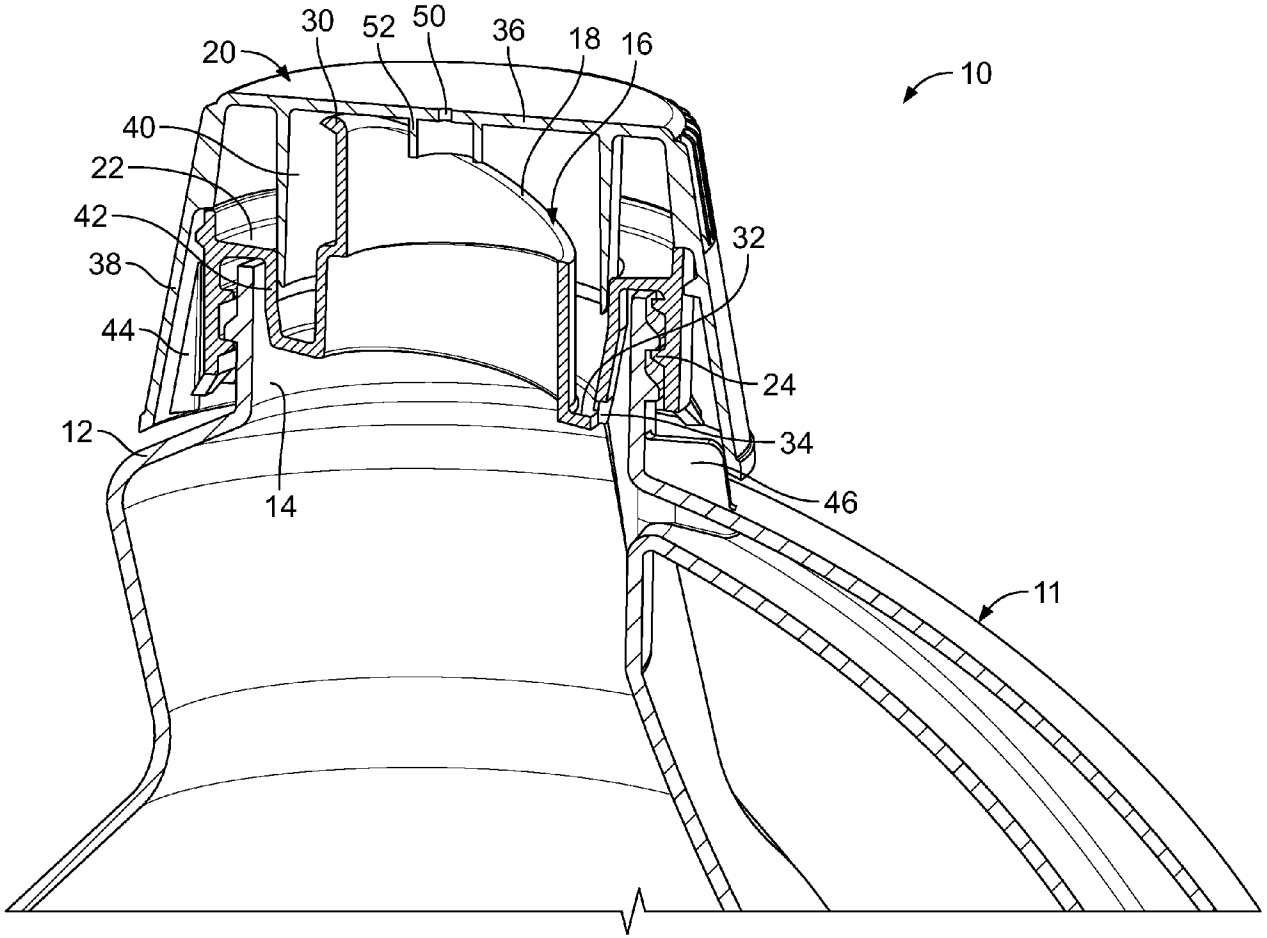
FIG. 2 is a sectional view thereof.

The dispensing closure 10 may be formed by injection molding or another method. It may be formed from plastic, or other materials. FIG. 1 shows one exemplary embodiment of the two-piece child-resistant dispensing closure of the present invention. FIG. 2 shows a sectional view of the dispensing closure.

The dispensing closure 10 may be configured to be secured to a container 11 that includes a shoulder 12 and an outwardly threaded neck 14 that extends upwardly from the shoulder.

The dispensing closure 10 includes a cap base 16 that secures to the container 11 and provides a pour spout 18 for the container. The dispensing closure also has a cap 20 that covers the cap base 16 when the user does not wish to dispense a product from the container 11.

The cap base 16 has a deck 22 and an outer base skirt 24 depending from the deck 22 for securing the cap base 16 to the container 11. An inner surface on the outer base skirt 24 is inwardly threaded for engaging an outwardly threaded dispensing neck 14 on a container 11. The outer base skirt 24 also has an outwardly threaded outer surface for securing the cap 20 to the cap base 16.

The cap base may have a ratcheting mechanism that locks the cap base to the container. The ratcheting mechanism is visible in the exploded views of the dispensing closure in FIGS. 3 and 4. At least one locking lug 26 is located on the shoulder 12 adjacent to the neck 14. The container may be provided separately by a manufacturer. At least one locking tab 28 extends from the outer base skirt, and engages a locking lug 26 on the container 11. When a user threadably secures the cap base 16 to the container 11, the locking tab 28 aligns the cap base 16 on the container and prevents removal of the cap base from the container. This is achieved by designing the locking tabs and locking lugs so that the locking tabs jump over the locking lugs as the cap base is tightened to the container, but the locking tabs are unable to jump back over the locking lugs if a user attempts to unscrew the cap base from the container.

Figure 3:
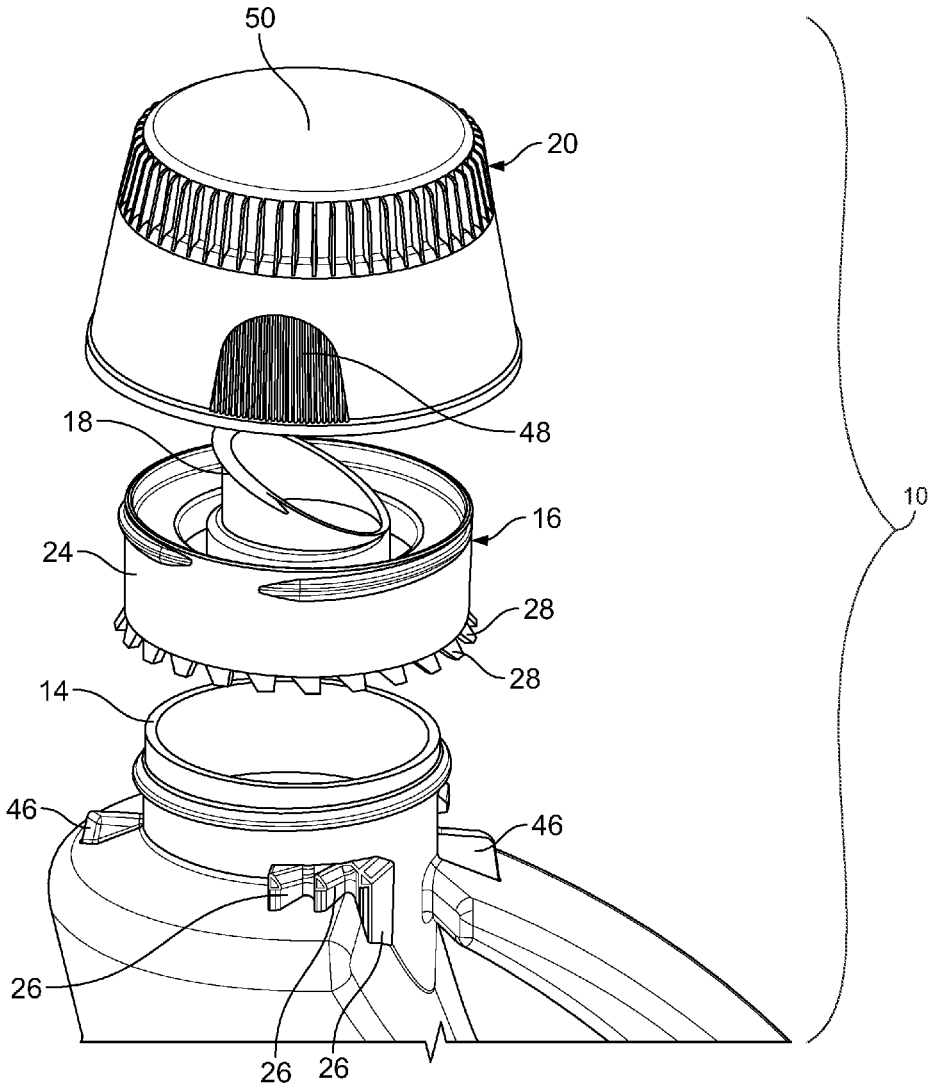
FIG. 3 is an exploded view thereof.
Figure 4:
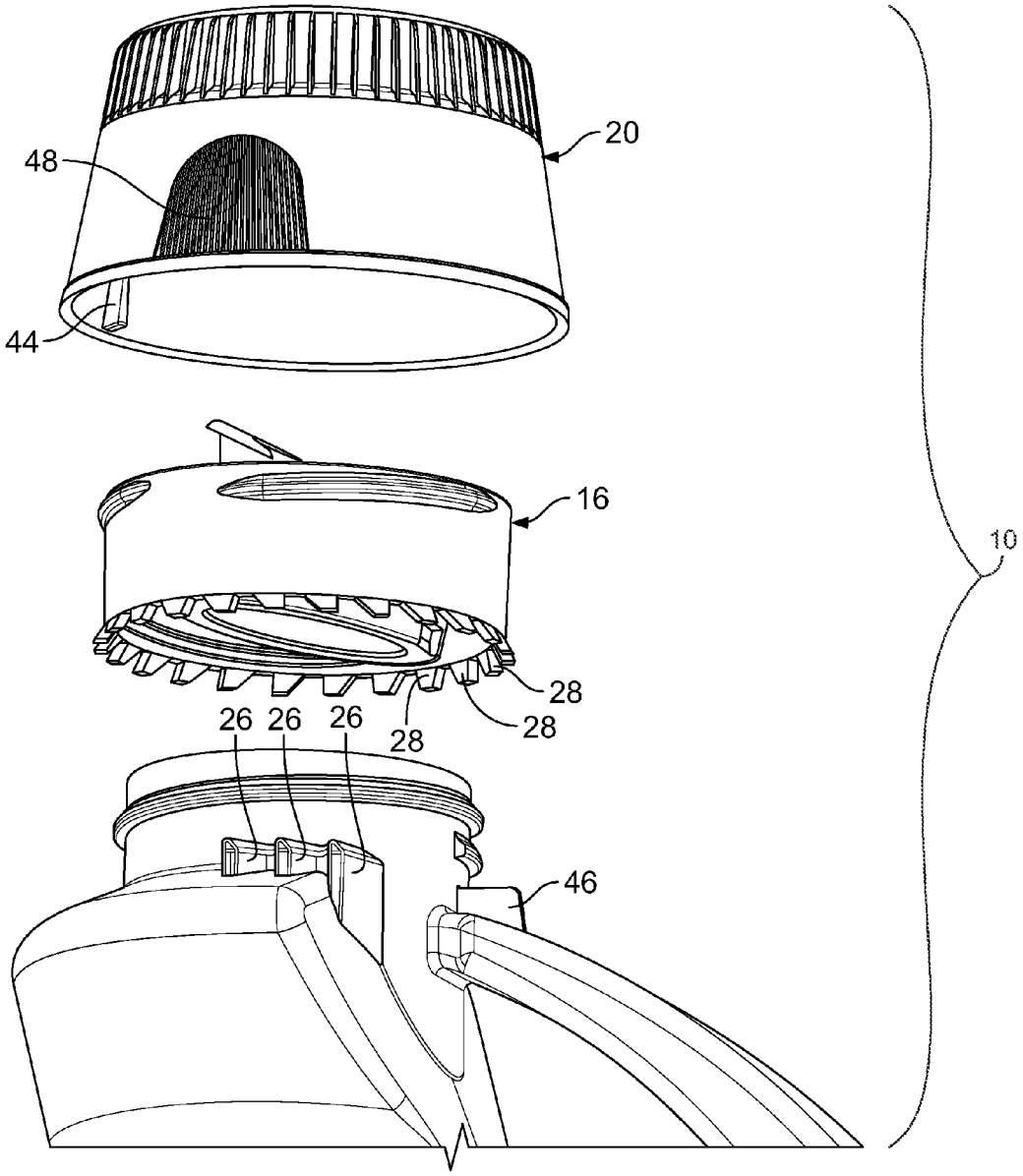
FIG. 4 is another view thereof.

In the exemplary embodiment shown in FIGS. 3 and 4, there are multiple locking tabs spaced around the lower edge of the outer base skirt, and there are three locking lugs on the shoulder of the container. There may be one or more locking tabs and locking lugs, without departing from the scope of the present invention.

Figure 5:
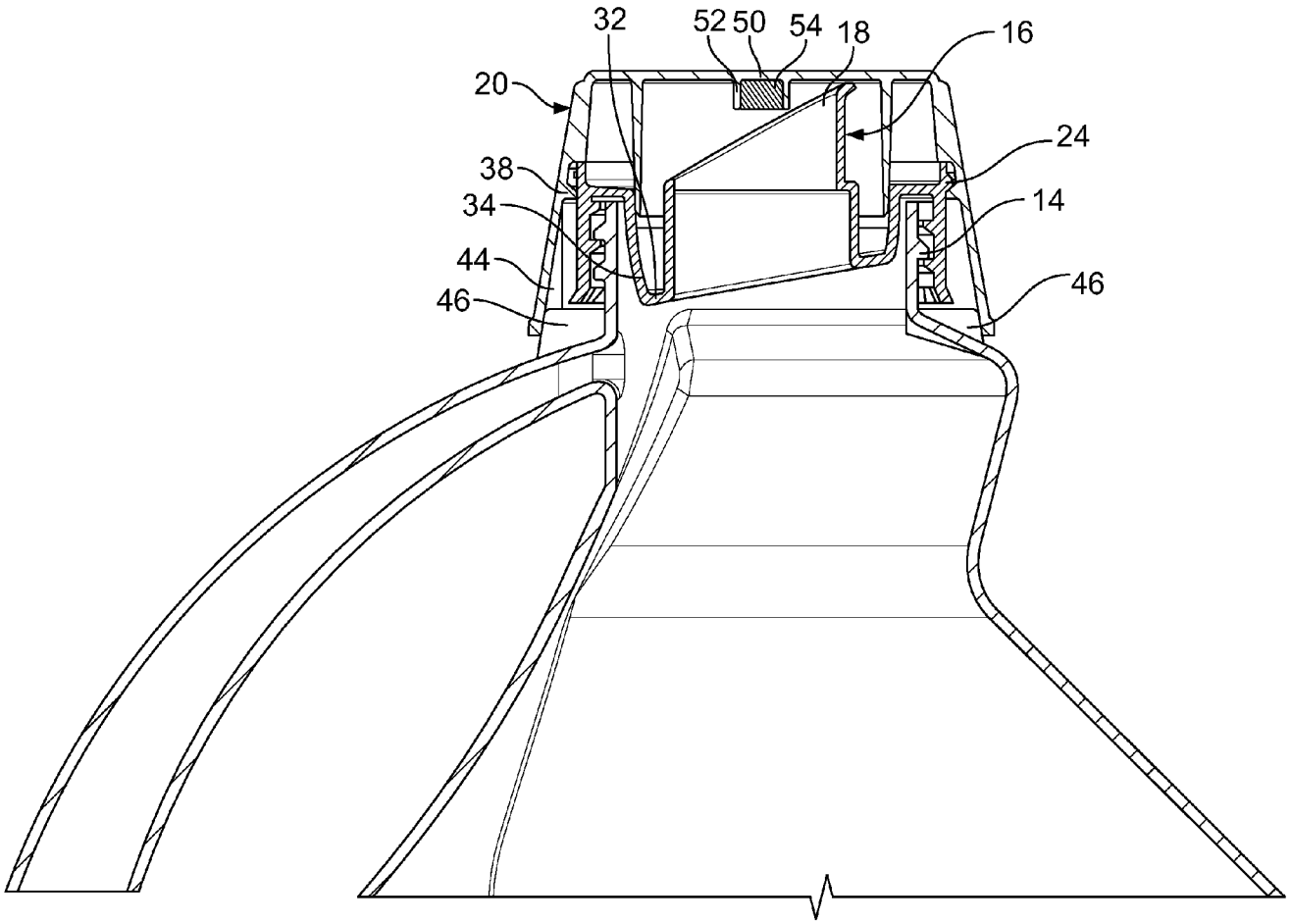
FIG. 5 is a cross-sectional view thereof.

To dispense a product from the container, the cap base 16 includes a pour spout 18 extending upwardly from the deck 22 of the cap base, shown in FIG. 5. The pour spout 18 has a front and a rear and a dispensing passage. A pour lip 30 may be formed at the front terminal edge of the pour spout for providing a clean pour of the product from the container.

The cap base may also have an annular drain back channel 32 encircling the pour spout 18 and depending downwardly from the deck 22 within the lower skirt 24. After dispensing a product from the container, any product that drips from the pour spout is directed back into the container by the annular drain back channel. The annular drain back channel has a bottom wall that slopes downwardly towards a rear terminal edge of the pour spout, and a drain back opening 34 is formed toward the rear of the drain back channel 32.

When a user does not wish to dispense a product from the container, the user secures a cap 20 to the cap base 16. The cap 20 has an upper wall 36 and an outer cap skirt 38 depending downwardly and outwardly from the upper wall. The cap skirt has an inwardly threaded inner surface for engaging the outwardly threaded lower skirt on the cap base 16. To seal the cap base, the cap may have an inner annular sealing wall 38 that depends downwardly from the upper wall 36. The annular sealing wall 40 is configured to engage an outer wall 42 of the drain back channel in the cap base so that it forms a seal.

To hold the cap 20 in this sealing position on the cap base 16 and to prevent inadvertent removal of the cap from the cap base, the dispensing closure may include a child resistant mechanism, including a child resistant stop tab 44 on the cap that engages a child resistant stop lug 46 on the container. The child resistant stop lug 46 may be located on the shoulder adjacent to the neck of the container. The child resistant stop tab 44 extends inwardly from the inner surface of the outer cap skirt 38 and engages the child resistant stop lug 46 on the container when the cap 20 is threadably engaged on the cap base. When the user is ready to unseal the dispensing closure of the exemplary embodiment, the user applies radial inward pressure to the outer cap skirt at opposing positions 48 spaced 90° from the child resistant stop tab 44. In an unstressed state, the lower edge of the outer cap skirt has a circular profile. When the user applies inward pressure on the outer cap skirt at the opposing positions 48, the outer cap skirt is deformed inwardly at the opposing positions and deformed outwardly at the location of the child resistant stop tab 44 so that the child resistant stop tab radially clears the child resistant stop lug. When the stop tab clears the stop lug, the user may unscrew the cap and dispense a product from the container.

The exemplary embodiment of FIGS. 1-5 has two stop tabs 44 formed in the cap skirt. The cap may include a single child resistant stop tab, two child resistant stop tabs, or more, as long as a user may disengage the child resistant stop tabs from the corresponding child resistant stop lugs on the container by squeezing the cap. Similarly, there may be more or fewer than two stop lugs on the container.

Some household products such as bleach require off-gassing vents to equalize pressure inside and outside the container when the container is closed. For this purpose, the cap may include an off-gassing aperture 50 in the upper wall 36 of the cap, as shown in FIG. 5. An annular wall 52 surrounds the off-gassing aperture 50 and frictionally receives an off-gassing insert 54. The off-gassing insert is gas permeable so that it permits gas exchange through the off-gassing aperture, but repels liquids and solid particles so they do not pass through the off-gassing aperture.

FIGS. 6-9 show another embodiment of the dispensing closure 10 of the present invention. In this exemplary embodiment, the child resistant mechanism may have a child resistant locking tab on the cap that engages a child resistant locking lug located on the cap base, rather than on the container neck.

In this exemplary embodiment, the cap base 16 is configured to engage a container 11 having a shoulder 12 and an outwardly threaded neck 14 extending upwardly from the shoulder. The container may be provided separately from the dispensing closure of the present invention.

Figure 6:
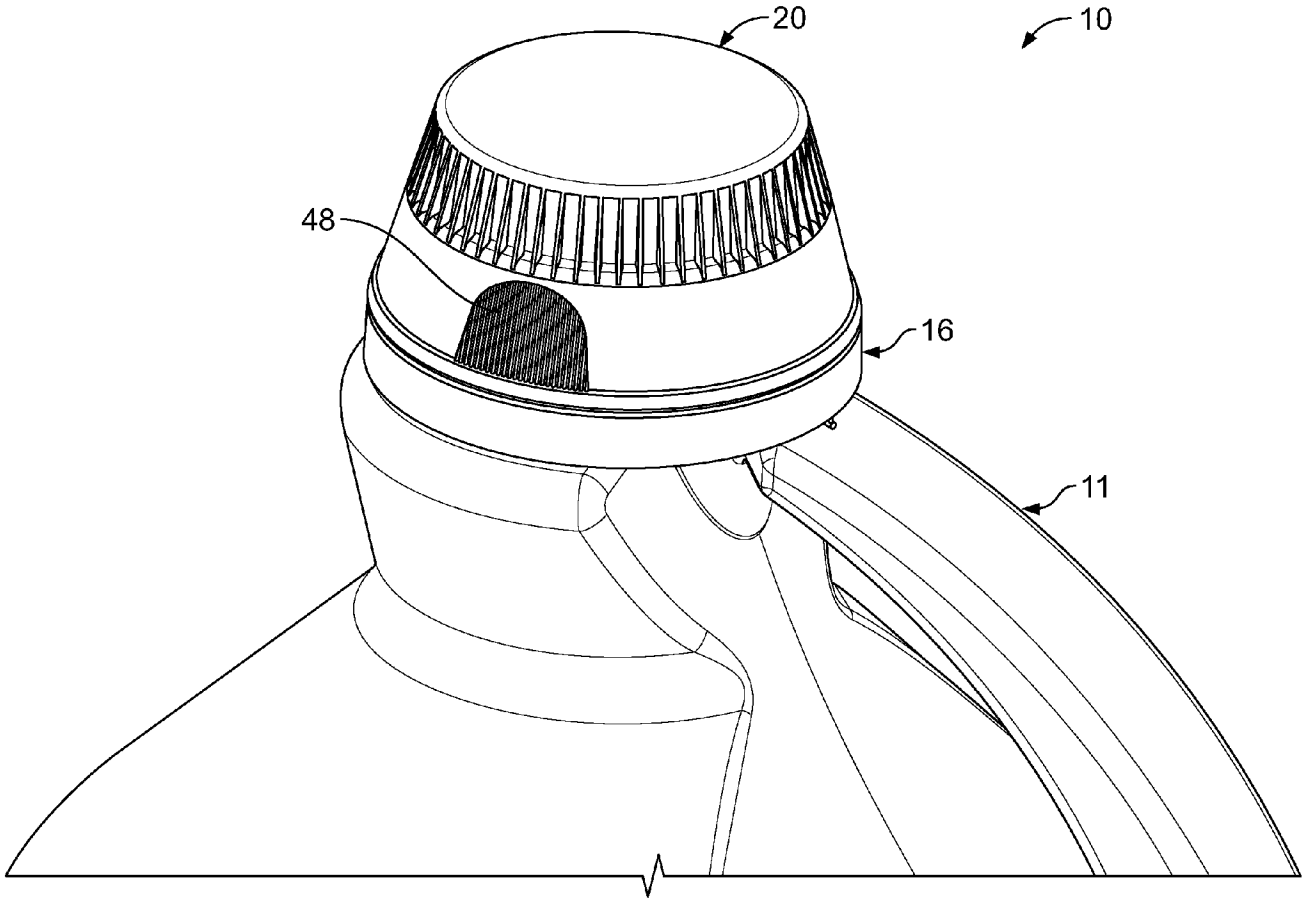
FIG. 6 is a perspective view of an exemplary embodiment of a dispensing closure of the present invention.

The dispensing closure of FIG. 6 has a cap 20 and a cap base 16. The cap base 16 includes a deck 22 and an outer base skirt 24 depending from the deck for securing the cap base to the neck of the container. The outer base skirt 24 has an inwardly threaded inner surface for engaging the outwardly threaded dispensing neck 14 on the container. The outer base skirt also has an outwardly threaded outer surface for securing the cap to the cap base.

Figure 7:
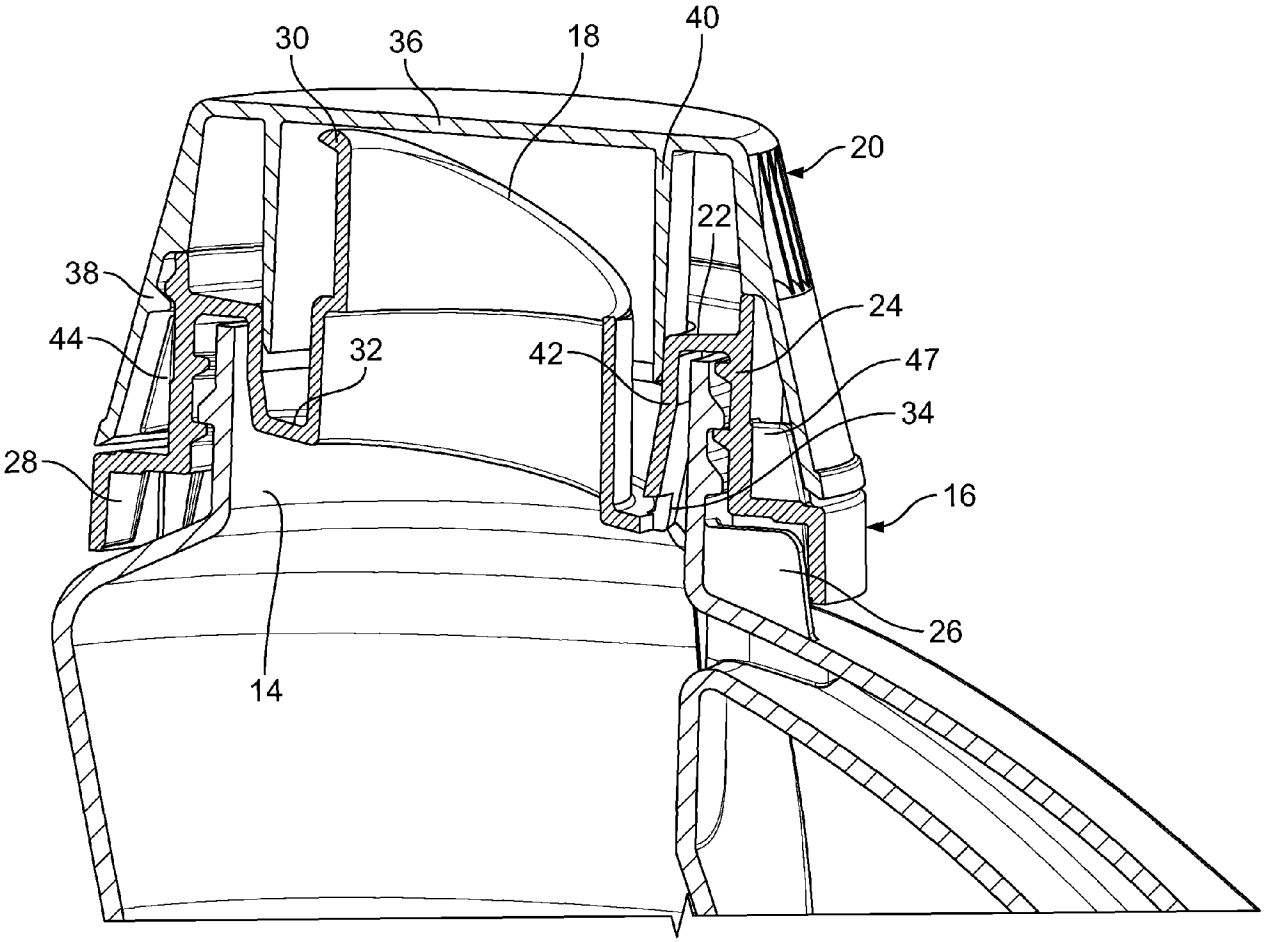
FIG. 7 is a sectional view thereof.
Figure 8:
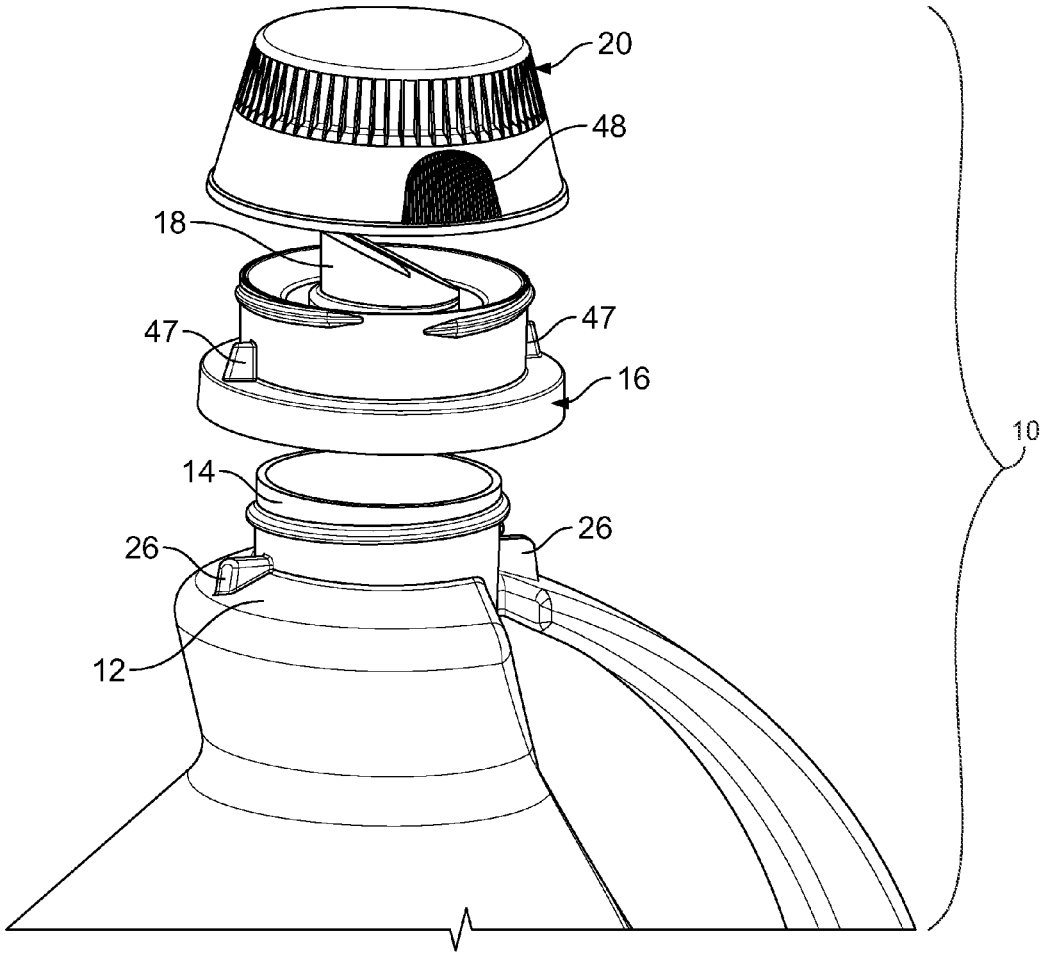
FIG. 8 is an exploded view thereof.
Figure 9:
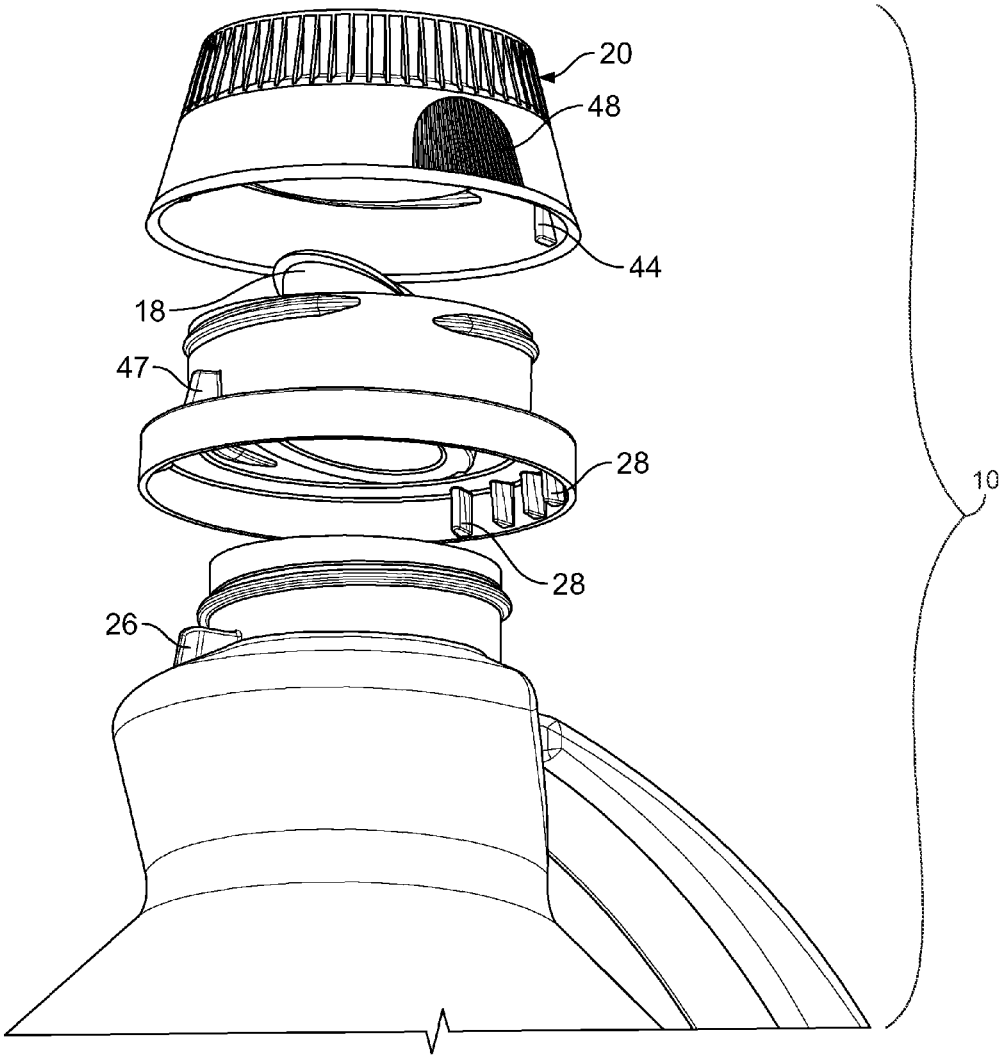
FIG. 9 is another view thereof.

The cap base may be secured to the container by a ratcheting mechanism, shown in FIG. 7. At least one locking lug 26 is formed on the shoulder adjacent to the neck. At least one locking tab 28 extends inwardly from the outer base skirt for engaging the locking lug 26 on the container. When a user threadably secures the cap base to the container, the interaction of the locking lug 26 with the locking tab 28 aligns the cap base on the container and prevents removal of the cap base from the container.

A pour spout 18 extends upwardly from the deck 22. The pour spout 18 has a front and a rear, and a dispensing passage within it. A pour lip 30 is formed at a front terminal edge of the pour spout, to provide a clean pour of a product from the container.

An annular drain-back channel 32 encircles the pour spout and depends downwardly from the deck 22 within the lower skirt. The drain-back channel has a bottom wall sloping downwardly towards a rear terminal edge of the pour spout. A drain-back opening 34 is formed in the drain-back channel so that a product may drain from the channel back into the container.

The dispensing closure has a cap 20 for sealing the cap base 16. The cap has an upper wall 36 and a cap skirt 38 depending downwardly and outwardly from the upper wall. The cap skirt has an inwardly threaded inner surface for engaging the outwardly threaded lower skirt on the cap base.

An inner annular sealing wall 40 depends downwardly from the upper wall 36. The annular sealing wall 40 is configured to form a seal on the outer wall 42 of the drain back channel in the cap base.

The dispensing closure may further have a child resistant mechanism. At least one child resistant stop lug 47 extends outwardly from the outer base skirt. A child resistant stop tab 44 extends inwardly from the inner surface of the outer cap skirt 38. To prevent inadvertent removal of the cap from the cap base, the child resistant stop tab 44 engages the child resistant stop lug 47 on the cap base when the threads on the cap engage the threads on the cap base. When the user is ready to dispense the product, the user applies inward pressure at opposing positions 48 on the outer cap skirt spaced 90° from the child resistant stop tabs 44 to deform the outer cap skirt so that the child resistant stop tab 44 clears the child resistant stop lug 47. In an unstressed state, the lower edge of the outer cap skirt has a circular profile. However, when the user applies inward pressure on the outer cap skirt at the opposing positions, the outer cap skirt is deformed inwardly at the opposing positions and deformed outwardly at the location of the child resistant stop tab so that the child resistant stop tab clears the child resistant stop lug.

The exemplary embodiment as shown in FIGS. 6-9 shows two stop tabs and two stop lugs. In variations of this embodiment, one or more stop tabs and stop lugs may be used without departing from the scope of the present invention.

Although not shown, the embodiment of FIGS. 6-9 may include an off-gassing aperture and off-gassing insert.

Figure 10:
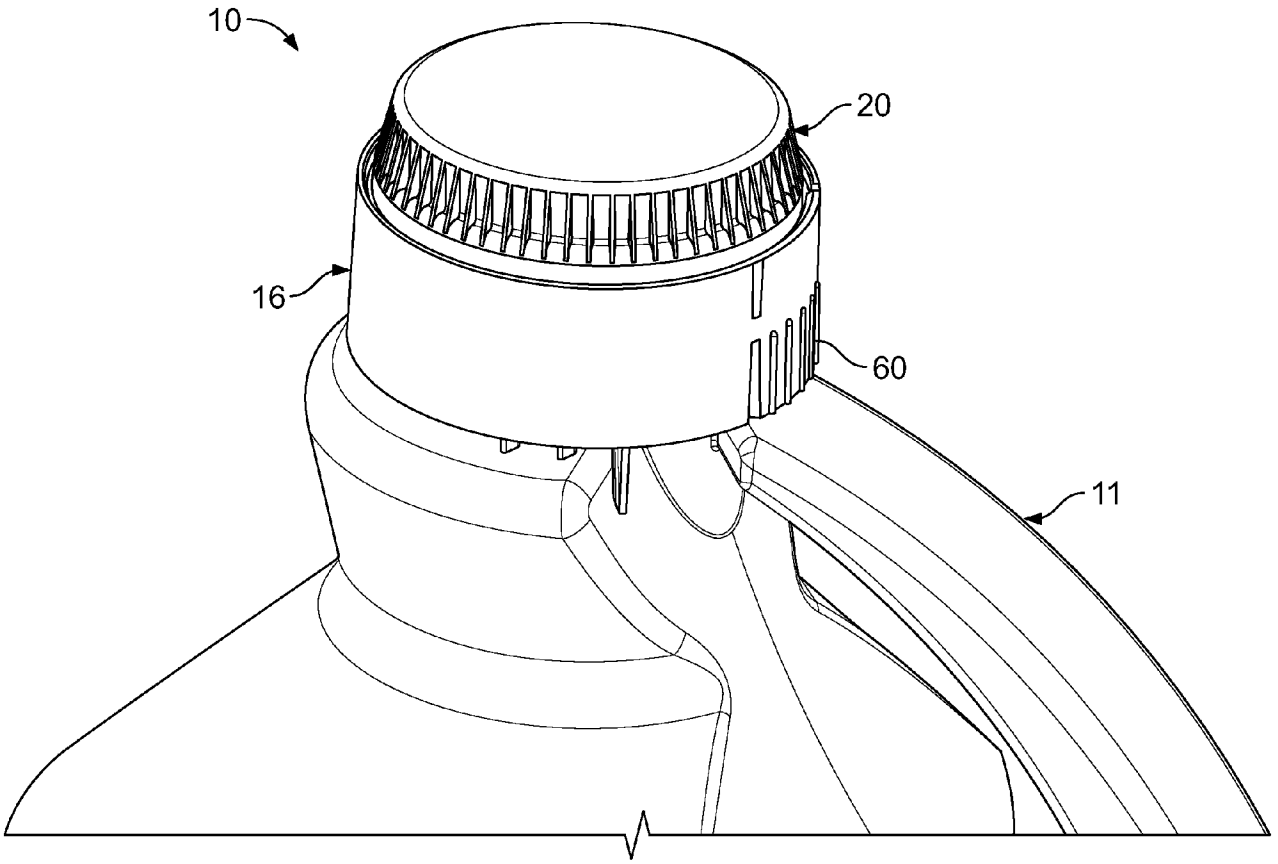
FIG. 10 is a perspective view of an exemplary embodiment of a dispensing closure of the present invention.
Figure 11:
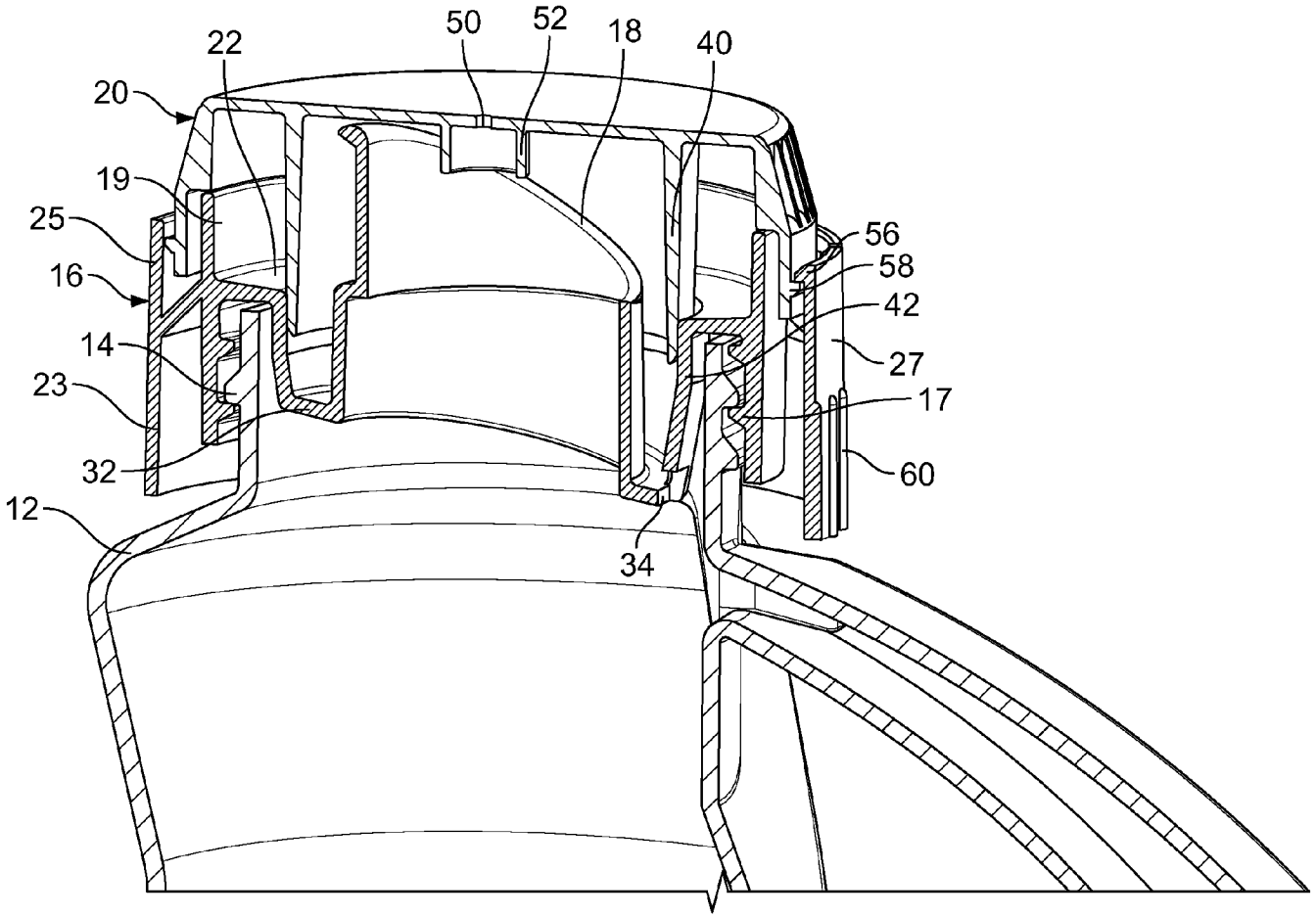
FIG. 11 is a sectional view thereof.
Figure 12:
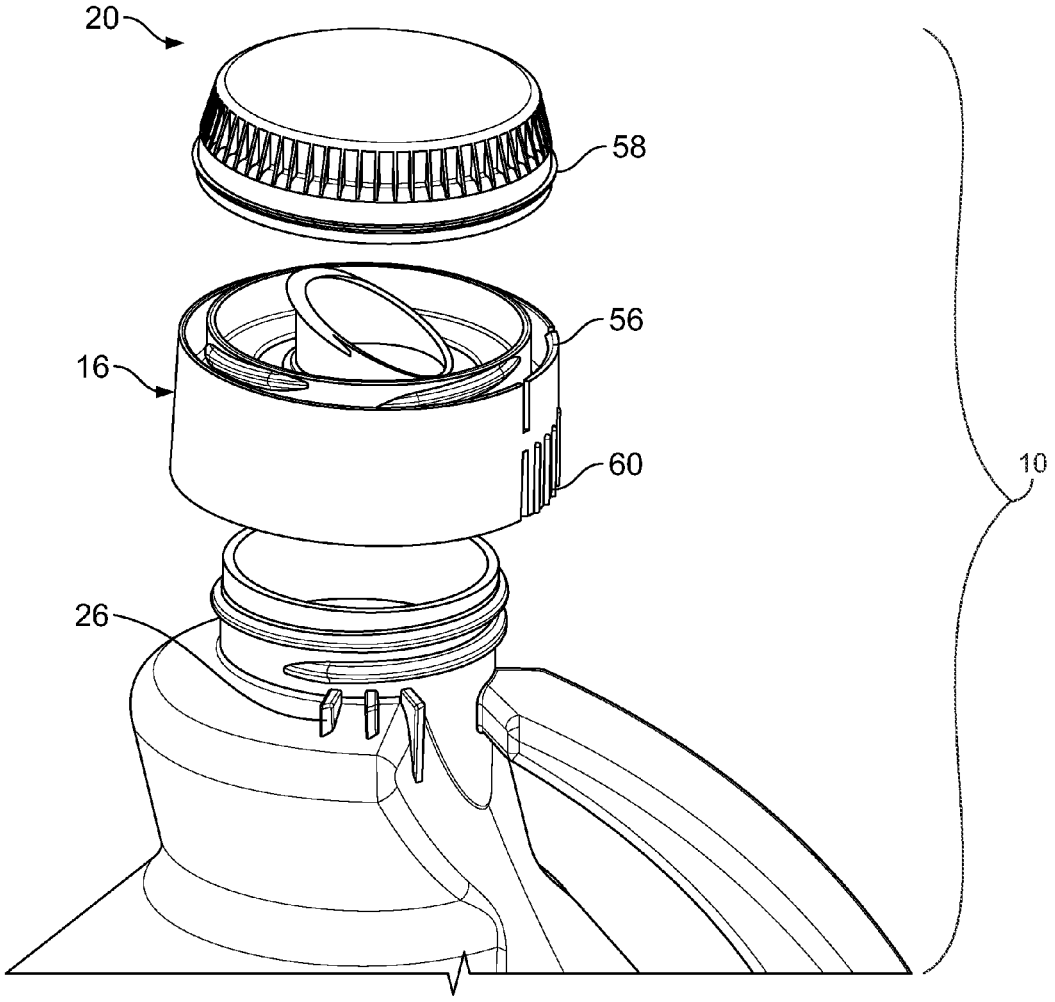
FIG. 12 is an exploded view thereof.
Figure 13:
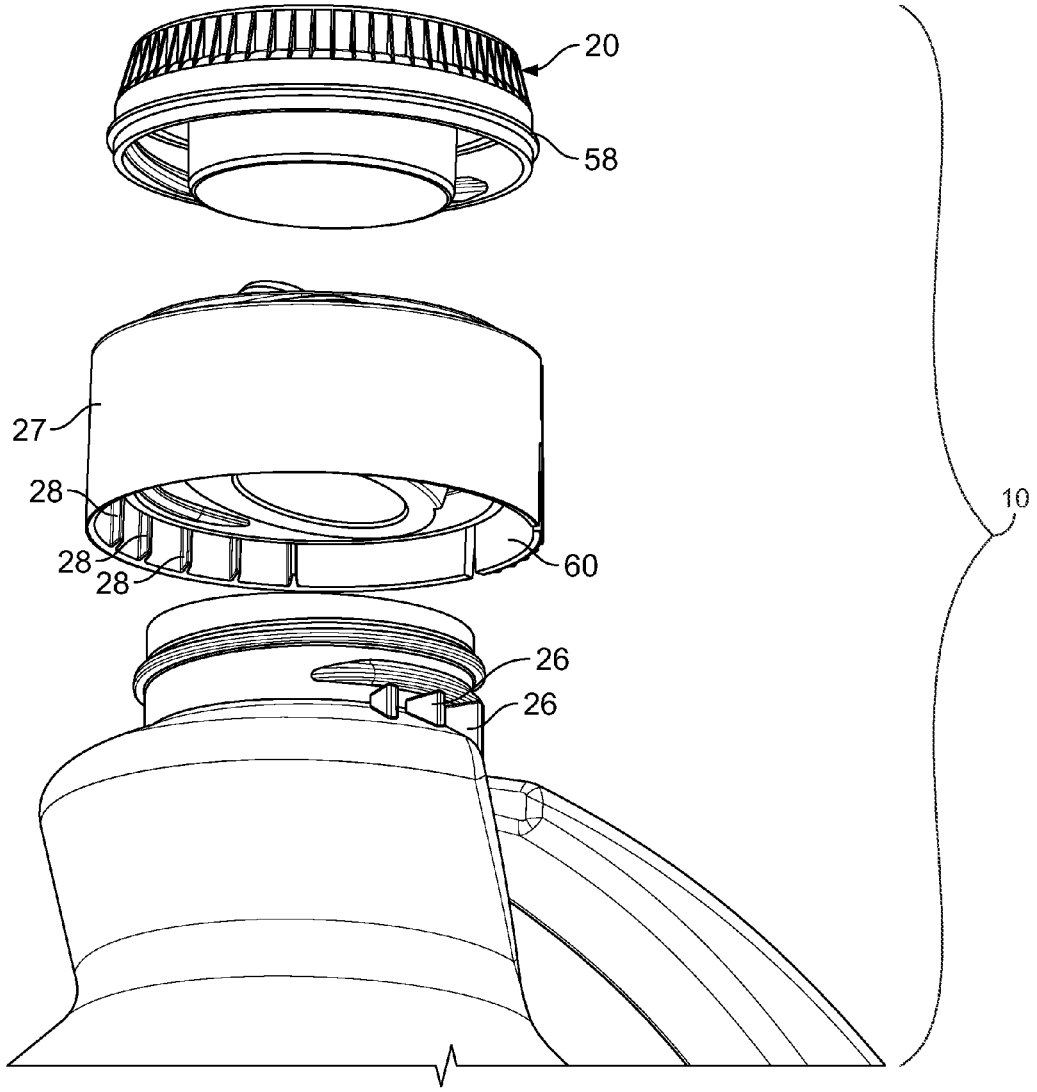
FIG. 13 is another view thereof.
Figure 14:
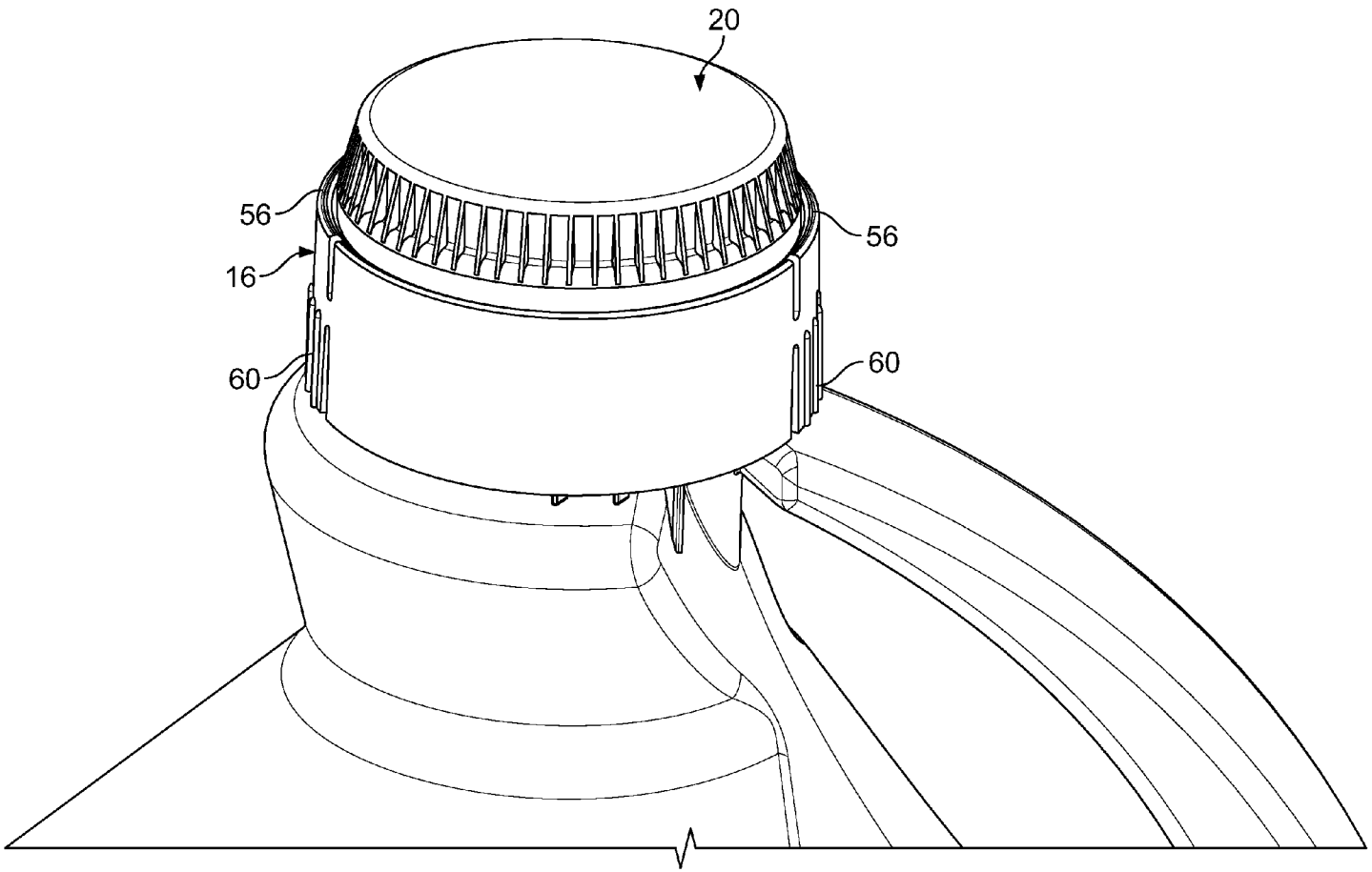
FIG. 14 is a perspective view of an exemplary embodiment of a dispensing closure of the present invention.
Figure 15:
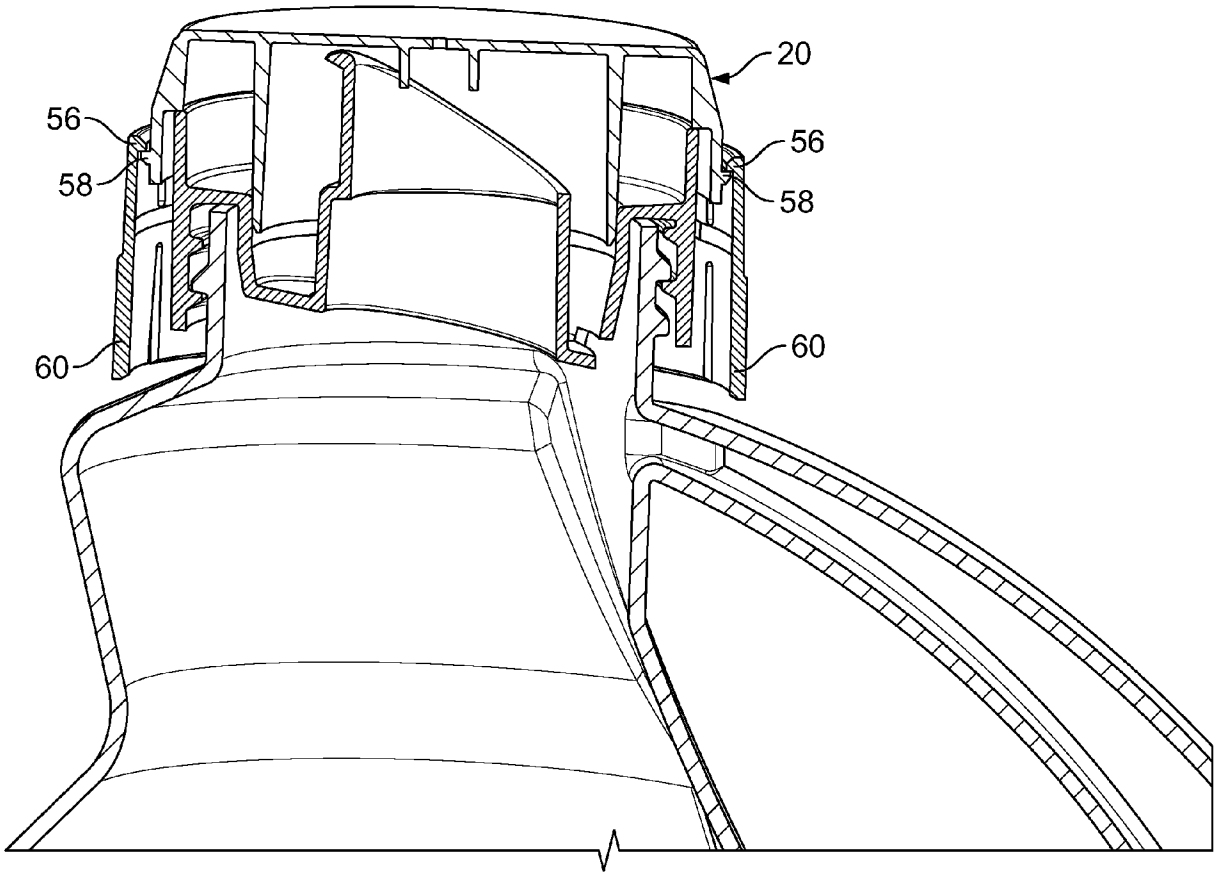
FIG. 15 is a sectional view thereof.
Figure 16:
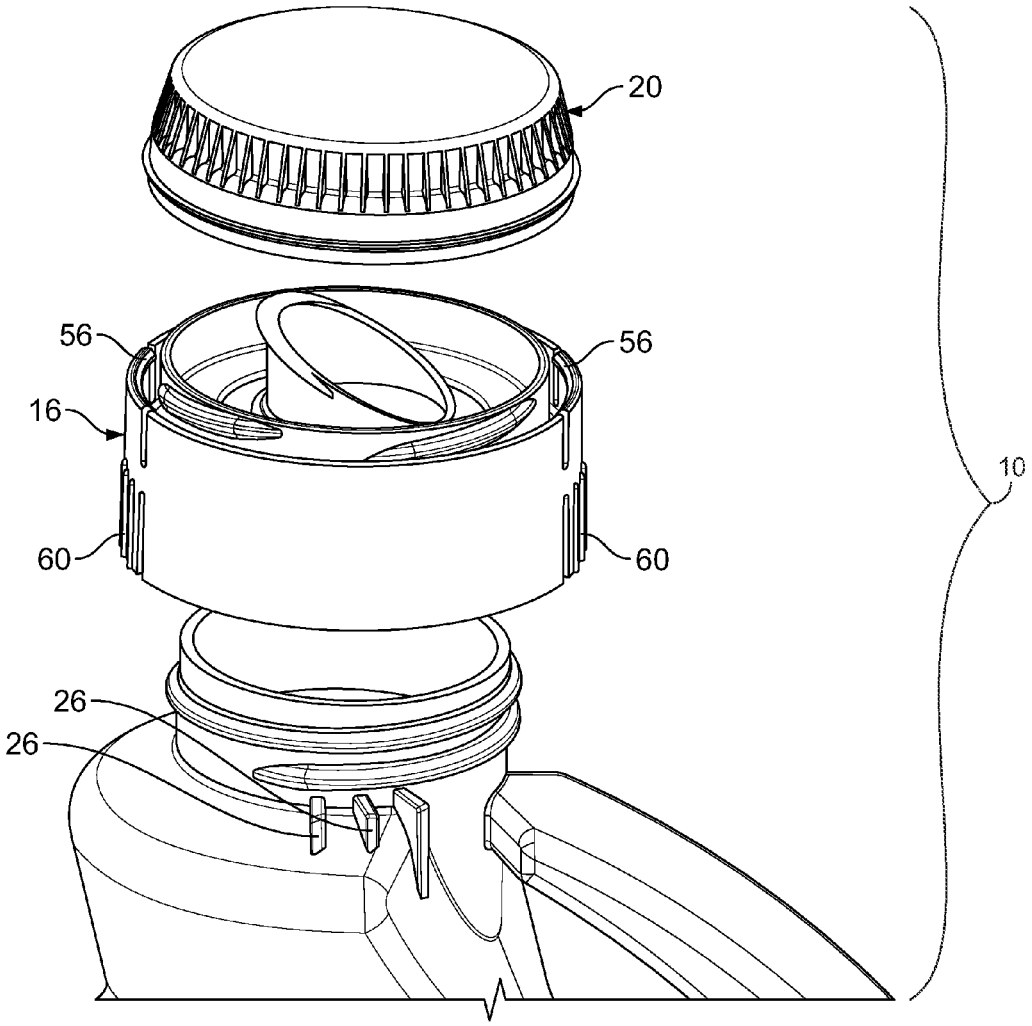
FIG. 16 is an exploded view thereof.
Figure 17:
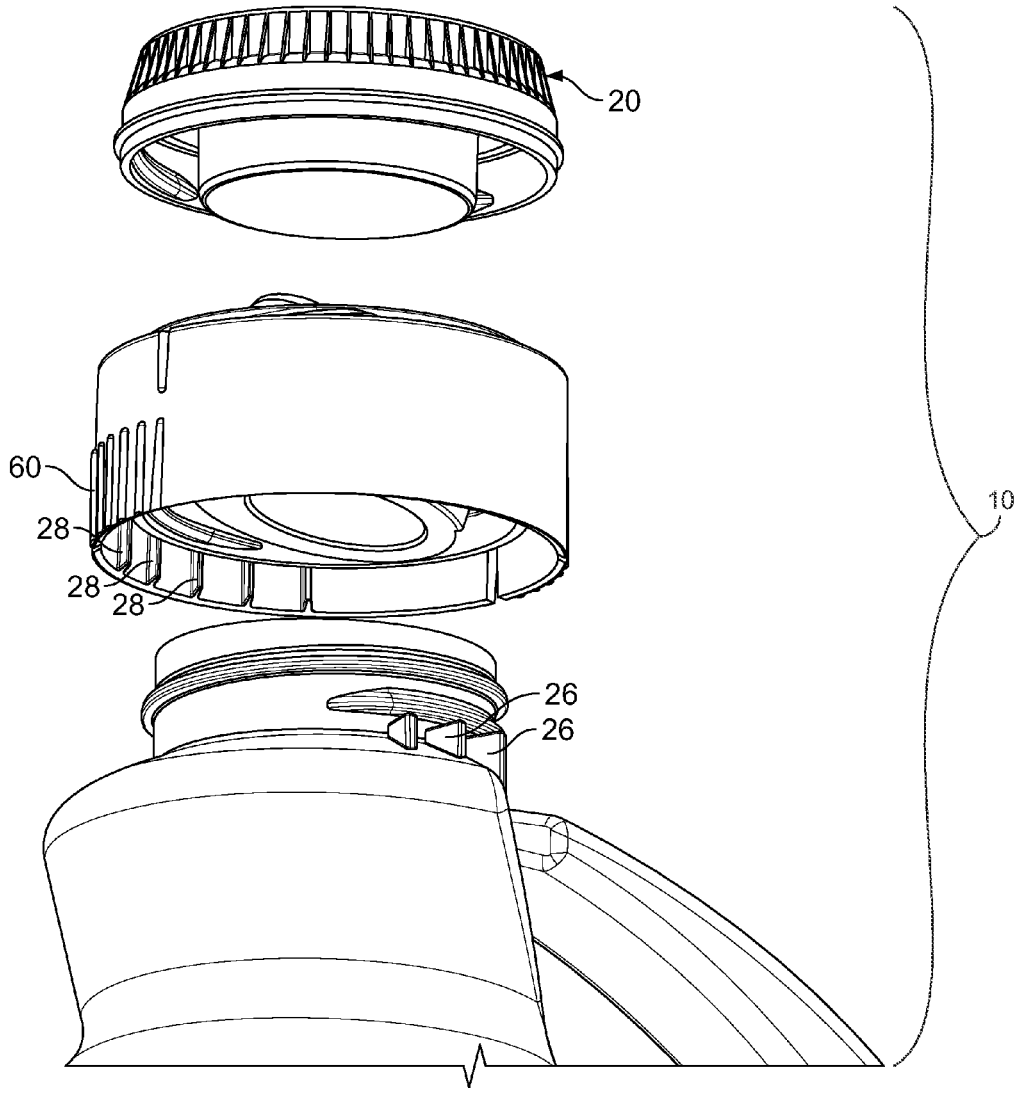
FIG. 17 is another view thereof.

FIG. 10 shows yet another exemplary embodiment of the dispensing closure 10 of the present invention. This embodiment has a two-piece dispensing closure having a child resistant mechanism in which a latch hook 56 on the cap base 16 engages a locking shoulder 58 on the cap 20.

The dispensing closure 10 is configured to dispense a product from a container 11 having a shoulder 12 and an outwardly threaded neck extending upwardly from the shoulder. At least one locking lug 26 is formed on the shoulder 12 adjacent to the neck 14 of the container 11. The container is not part of the present invention and may be provided separately from the dispensing closure.

The dispensing closure 10 has a cap base 16 and a cap 20. The cap base 16 has a deck 22 and an inner lower skirt 17 depending downwardly from the deck 22. The inner lower skirt 17 has an inwardly threaded inner surface for engaging an outwardly threaded dispensing neck on a container. An upper skirt 19 extends upwardly from the deck 22.

An outer peripheral skirt 27 is formed around the deck 22. The outer peripheral skirt 27 has a lower portion 23 that depends downwardly from the deck and an upper portion 25 that extends upwardly from the deck 22. At least one locking tab 28 extends inwardly from the lower portion 23 of the outer peripheral skirt 27. The locking tab 28 engages the locking lug 26 on the container 11 to align the cap base on the container and prevent removal of the cap base from the container.

A pour spout 18 extends upwardly from the deck 22. The pour spout 18 has a front and a rear, and a dispensing passage is defined within the pour spout 18 so that a product may be dispensed from a container 11 through the cap base. A pour lip 30 may be formed at a front terminal edge of the pour spout 18.

An annular drain-back channel 32 may encircle the pour spout 18 and depend downwardly from the deck 22 within the inner lower skirt 17. The drain-back channel 32 has a bottom wall that slopes downwardly toward a rear terminal edge of the pour spout. A drain back opening 34 is formed in the drain-back channel 32 so that a product may drain from the channel back into the container 11.

To seal the dispensing closure 10, the user secures a cap to the cap base. The cap has an upper wall 36 and an outer cap skirt depending downwardly from the upper wall. The cap skirt has an inwardly threaded inner surface for engaging the outwardly threaded upper skirt 19 of the cap base.

An inner annular sealing wall 40 depends downwardly from the upper wall 36. The annular sealing wall 40 is configured to form a seal on the outer wall 42 of the drain-back channel in the cap base.

At least one latch hook 56 extends inwardly from an upper edge of the outer peripheral skirt of the cap base. The latch hook engages a stepped locking shoulder 58 formed on an outer surface of the cap skirt. When a user threadably secures the cap to the cap base, the latch hook prevents removal of the cap from the cap base.

At least one latch hook actuator tab 60 is formed on the peripheral skirt of the cap base for releasing the latch hook 56. When a radial inward pressure is applied to the latch hook actuator tab 60, the latch hook 56 is moved in a radial outward direction so that the latch hook 56 disengages the stepped shoulder 58, and the cap may be removed from the cap base.

The cap base may include on ore more latch hooks and actuator tabs. FIGS. 10-13 show only one latch hook while FIGS. 14-17 show two latch hooks. The single latch hook of FIGS. 10-13 has an actuator tab that is positioned so that a user holding a container with one hand may use the thumb on that hand to depress the actuator tab. The user then unscrews the cap with the other hand to remove the cap from the cap base. Where there are two latch hooks, as in FIGS. 14-17, the user uses one hand to depress the actuator tabs and the other hand to unscrew the cap to remove the cap from the cap base.

Figure 18:
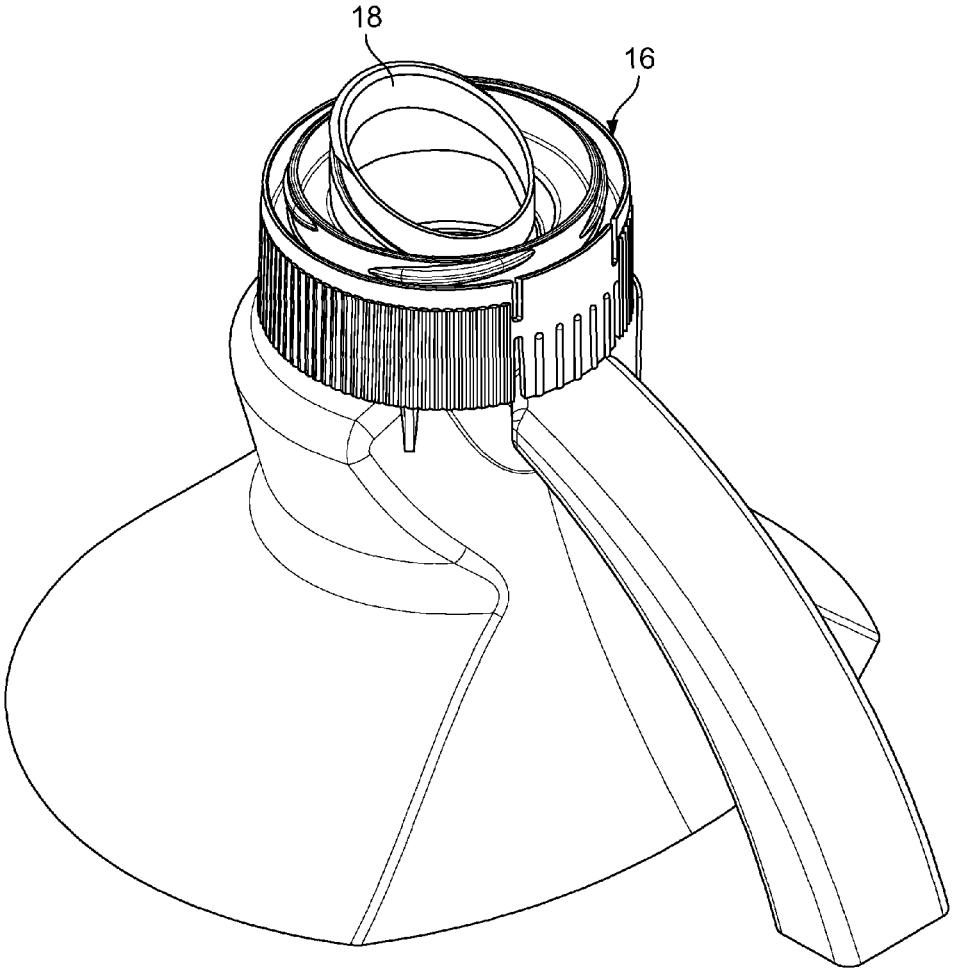
FIG. 18 is a perspective view of an exemplary embodiment of a dispensing closure of the present invention with the cap removed.
Figure 19:
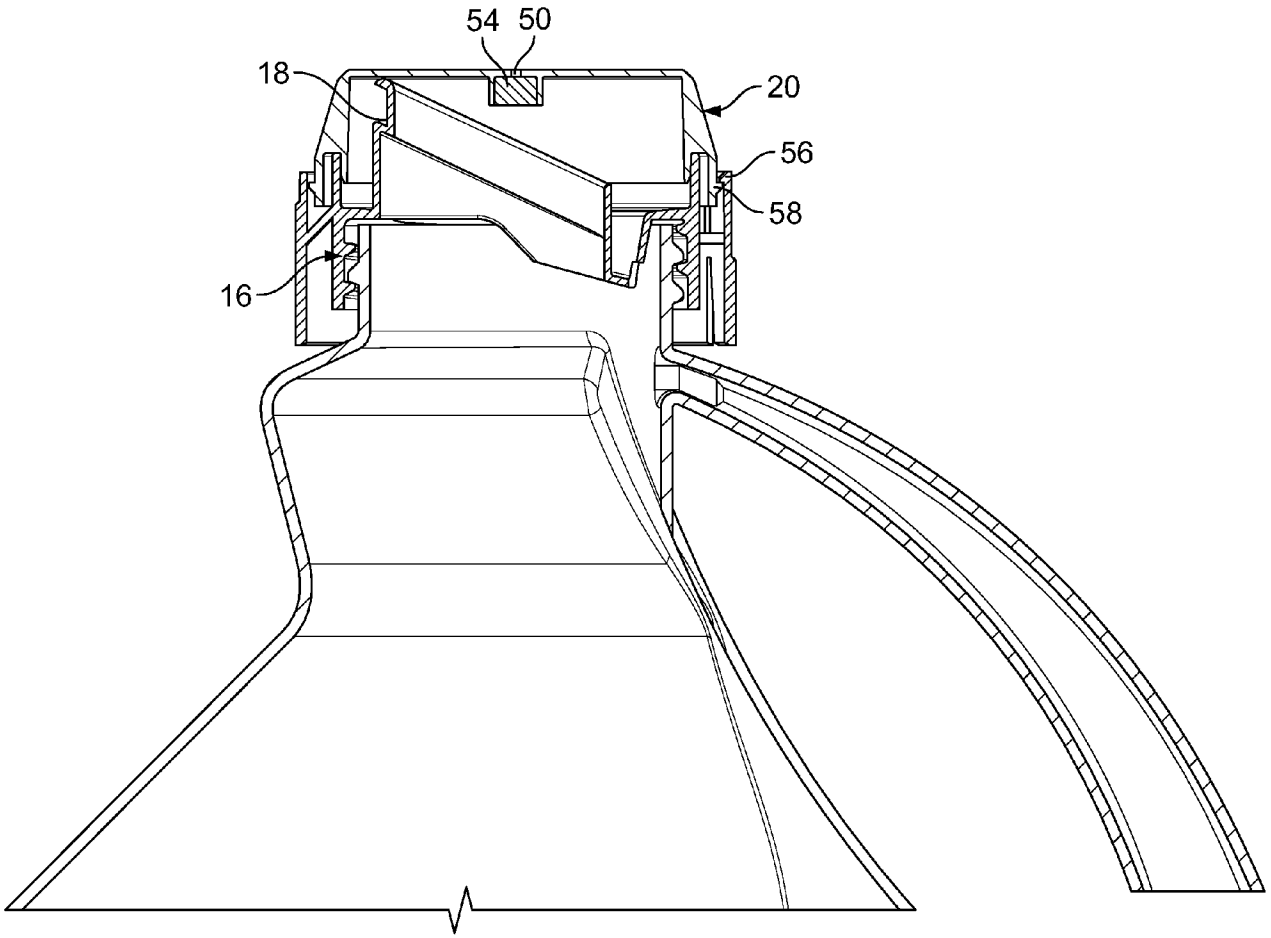
FIG. 19 is a cross-sectional view thereof.
Figure 20:
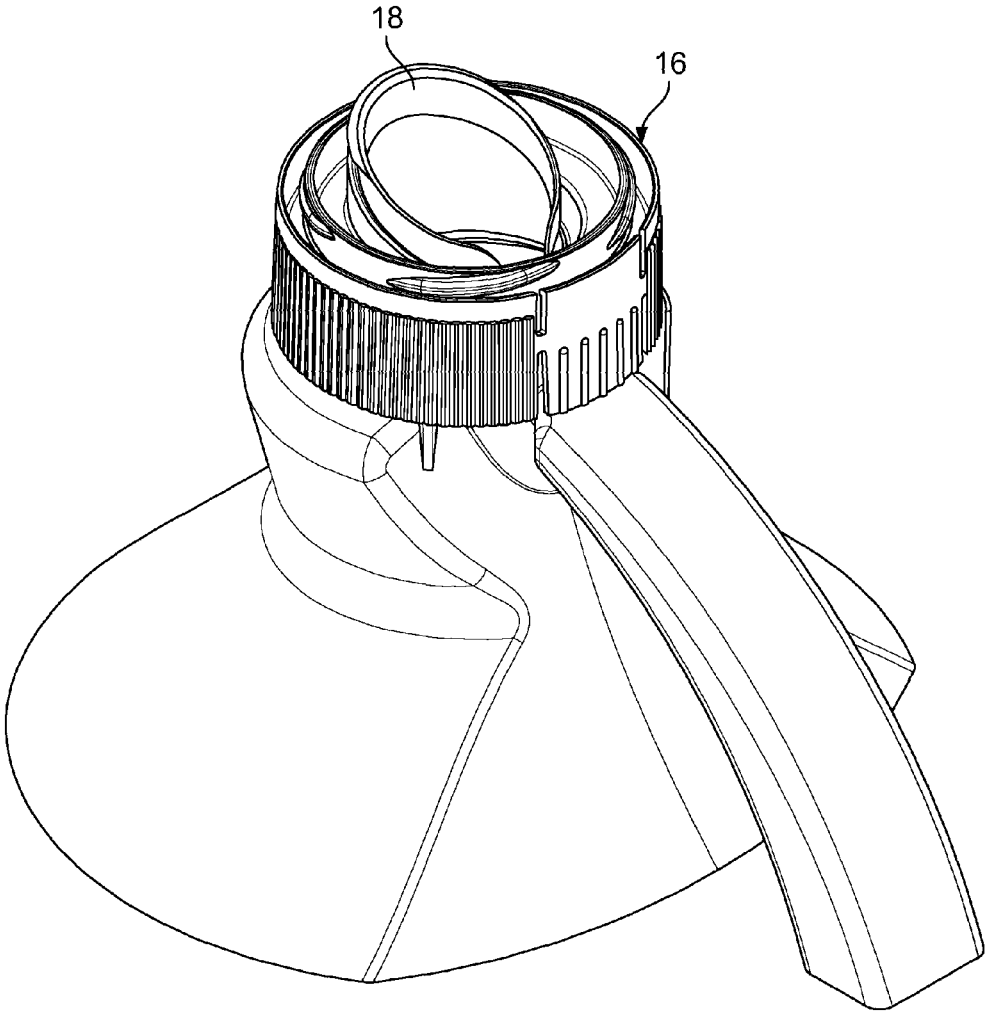
FIG. 20 is a perspective view of an exemplary embodiment of a dispensing closure of the present invention with the cap removed.
Figure 21:
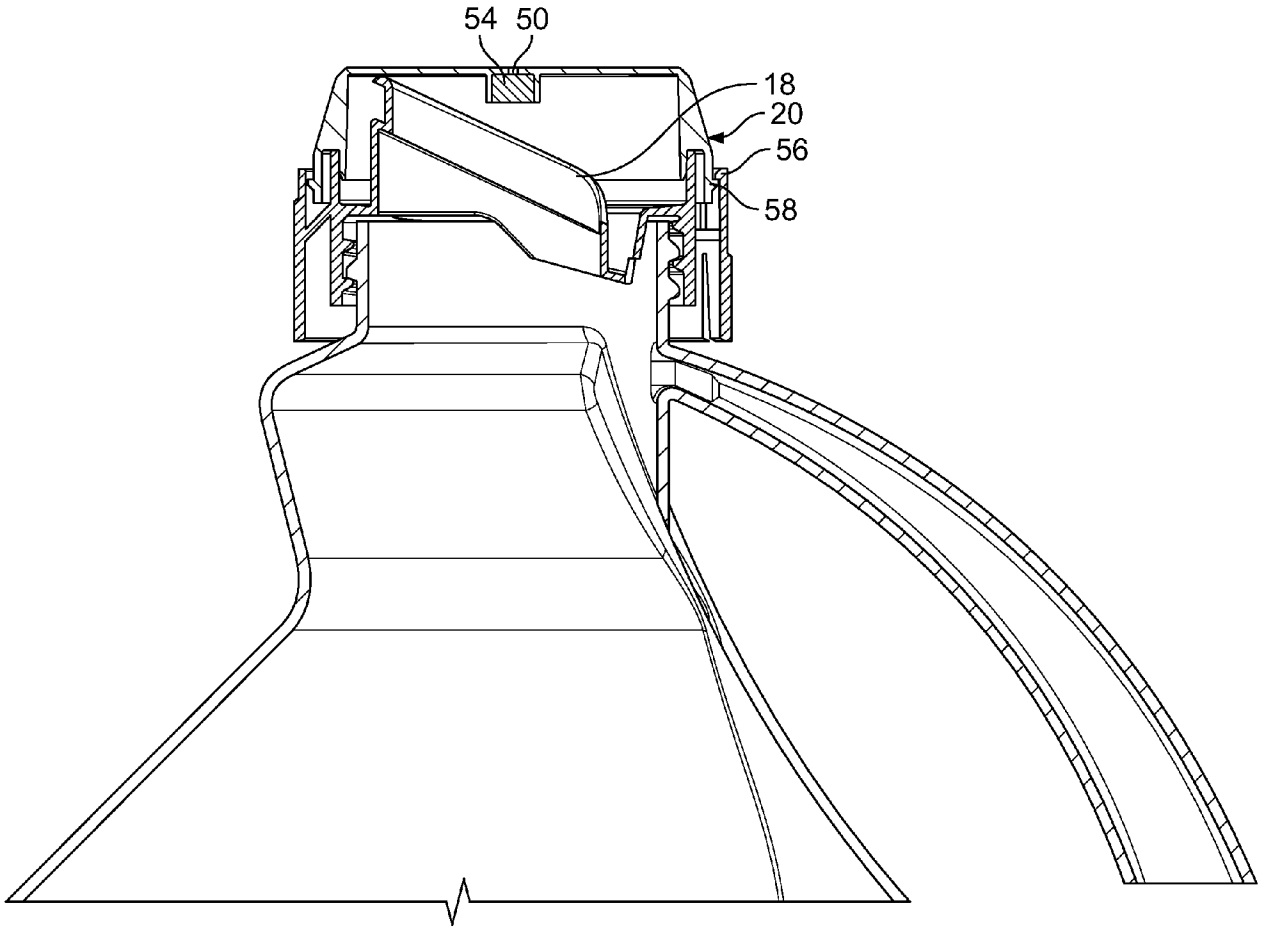
FIG. 21 is a cross-sectional view thereof.

The cap base may include a wider pour spout, as shown in FIGS. 18 and 19. It may also include a gap in the rear side of the pour spout, opposite the pour lip, as shown in FIGS. 20 and 21.

It can therefore be seen that the exemplary embodiment include a clean pour spout cutoff, a drain back well, anti-glug dispensing, vented pouring, and a vented cap lid insert. The dispensing closure may also have a ratcheting lock and orientation system. The dispensing closure may also have a child resistant mechanism that is disengaged by either squeezing a cap or pressing an actuator tab. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A child resistant dispensing closure for dispensing a product from a container, said container including a shoulder, an outwardly threaded neck extending upwardly from said shoulder, at least one locking lug on said shoulder adjacent to said neck, and at least one child resistant stop lug on said shoulder adjacent to said neck, said at least one locking lug extending above said at least on child resistant stop lug, said child resistant stop lug extending radially further away from said neck than said locking lug, said dispensing closure comprising:

a cap base including a deck, an outer base skirt depending from said deck, said outer base skirt having an inwardly threaded inner surface for engaging said outwardly threaded dispensing neck on said container, said outer base skirt further having an outwardly threaded outer surface, at least one locking tab extending from said outer base skirt, said locking tab engaging said locking lug on said container to align said cap base on said container when said cap base is threadably engaged on said container neck and to prevent removal of said cap base from said container when said cap base is threadably engaged on said container neck, said outer base skirt remaining above said child resistant stop lug when threadably engaged on said container, a pour spout extending upwardly from said deck, said pour spout having a front and a rear and a dispensing passage therein, said pour spout having a pour lip formed at a front terminal edge thereof, an annular drain back channel encircling said pour spout and depending downwardly from said deck within said lower skirt, said drain back channel having a bottom wall sloping downwardly towards a rear terminal edge of said pour spout, a drain back opening formed in said drain back channel so that a product may drain from said channel back into said container; and a cap including an upper wall, an outer cap skirt depending downwardly and outwardly from said upper wall and below said outer base skirt, said cap skirt having an inwardly threaded inner surface for engaging said outwardly threaded lower skirt on said cap base, an inner annular sealing wall depending downwardly from said upper wall, said annular sealing wall being configured to sealingly engage an outer wall of said drain back channel in said cap base, and a child resistant stop tab extending inwardly from said inner surface of said outer cap skirt, said child resistant stop tab being engageable with said child resistant stop lug on said container when said cap is threadably engaged with said cap base to prevent inadvertent removal of said cap from said cap base unless a radial inward pressure is applied to the outer cap skirt at opposing positions spaced from the child resistant stop tab to deform the outer cap skirt outwardly so that the child resistant stop tab clears the child resistant stop lug.

2. The dispensing closure of claim 1 further comprising:

an off-gassing aperture in said upper wall of said cap;

an annular wall surrounding said off-gassing aperture; and an off-gassing insert frictionally received within said annular wall, said off-gassing insert permitting gas exchange therethrough and repelling liquids and particles from said off-gassing aperture.

3. A child resistant dispensing closure for dispensing a product from a container, said container including a shoulder, an outwardly threaded neck extending upwardly from said shoulder, and at least one locking lug on said shoulder adjacent to said neck, said dispensing closure comprising:

a cap base including a deck, an inner lower skirt depending downwardly from said deck, said inner lower skirt having an inwardly threaded inner surface for engaging said outwardly threaded dispensing neck on said container, an upper skirt extending upwardly from said deck, said upper skirt having an outwardly threaded outer surface, an outer peripheral skirt having a lower portion depending downwardly from said deck and an upper portion extending upwardly from said deck, said lower portion having at least one locking tab extending inwardly therefrom, said locking tab engaging said locking lug on said container to align said cap base on said container when said cap base is threadably engaged on said container neck and to prevent removal of said cap base from said container when said cap base is threadably engaged on said container neck, a pour spout extending upwardly from said deck, said pour spout having a front and a rear and a dispensing passage therein, said pour spout having a pour lip formed at a front terminal edge thereof, an annular drain back channel encircling said pour spout and depending downwardly from said deck within said lower skirt, said drain back channel having a bottom wall sloping downwardly towards a rear terminal edge of said pour spout, a drain back opening formed in said drain back channel so that a product may drain from said channel back into said container; and a cap including an upper wall, an outer cap skirt depending downwardly from said upper wall, said cap skirt having an inwardly threaded inner surface for engaging said outwardly threaded upper on said upper skirt of said cap base, an inner annular sealing wall depending downwardly from said upper wall, said annular sealing wall being configured to sealingly engage an outer wall of said drain back channel in said cap base, and a stepped locking shoulder on an outer surface of said cap skirt, said outer peripheral skirt of said cap base including at least one inwardly extending latch hook on an upper edge thereof for engaging said stepped locking shoulder on said cap skirt when said cap is threadably received on said cap base to prevent inadvertent removal of said cap from said cap base, said outer peripheral skirt of said cap base further including at least one latch hook actuator tab integrally formed as a part thereof adjacent said latch hook, wherein a radial inward pressure on said latch hook actuator tab causes a corresponding radial outward movement of said latch hook to disengage said latch hook from said stepped shoulder and allow removal of said cap.

4. The dispensing closure of claim 3 further comprising:

an off-gassing aperture in said upper wall of said cap;

an annular wall surrounding said off-gassing aperture; and an off-gassing insert frictionally received within said annular wall, said off-gassing insert permitting gas exchange therethrough and repelling liquids and particles from said off-gassing aperture.

* * * * *